US006071177A

United States Patent [19]

Lin et al.

[11] Patent Number: 6,071,177

[45] Date of Patent: Jun. 6, 2000

[54] METHOD AND APPARATUS FOR DETERMINING END POINT IN A POLISHING PROCESS

[75] Inventors: C. L. Lin, Taipei; Tin Chun Wang, Tao-Yan, both of Taiwan

[73] Assignee: Taiwan Semiconductor Manufacturing Co., Ltd, Hsin-Chu, Taiwan

[21] Appl. No.: 09/281,604

[22] Filed: Mar. 30, 1999

[51] Int. Cl.[7] ..... B24B 1/00

[52] U.S. Cl. ..... 451/6; 451/41; 451/10; 451/285; 451/287; 156/345; 438/692; 356/375

[58] Field of Search ..... 451/6, 10, 11, 451/41, 285, 287, 288; 156/345; 438/691, 692, 693; 356/375

[56] References Cited

U.S. PATENT DOCUMENTS

| | | | |
|---|---|---|---|
| 5,433,651 | 7/1995 | Lustig et al. | 451/6 |
| 5,461,007 | 10/1995 | Kobayashi . | |
| 5,643,044 | 7/1997 | Lund | 451/285 |
| 5,722,875 | 3/1998 | Iwashita et al. | 451/288 |
| 5,872,633 | 2/1999 | Holzapfel et al. | 451/6 |
| 5,893,796 | 4/1999 | Birang et al. | 451/287 |
| 5,899,792 | 5/1999 | Yagi | 451/6 |
| 5,910,846 | 6/1999 | Sandhu | 451/6 |
| 5,948,203 | 9/1999 | Wang | 156/345 |
| 5,949,927 | 9/1999 | Tang | 385/12 |

*Primary Examiner*—Eileen P. Morgan
*Attorney, Agent, or Firm*—Tung & Associates

[57] ABSTRACT

A method for determining an end point in a chemical mechanical polishing process by utilizing a dual wavelength interference technique and an apparatus for carrying out such method are provided. In the method, a rotating platen that is equipped with a laser generating source capable of generating laser emissions in two different wavelengths is utilized such that a dual wavelength interference pattern may be received by a laser detector and a greatly expanded period between cycles in a resulting dual wavelength interference pattern may be utilized to determine the end point for material removal in a significantly larger thickness of material. The present invention novel method and apparatus can be utilized not only in monitoring the end point of CMP polishing of a thin oxide layer such as ILD or STI, but also in material removal of larger thickness such as in the planarization process of an IMD layer.

28 Claims, 4 Drawing Sheets

METHOD AND APPARATUS FOR DETERMINING END POINT IN A POLISHING PROCESS

FIELD OF THE INVENTION

The present invention generally relates to a method and an apparatus for determining an end point in a polishing process and more particularly, relates to a method and an apparatus for determining an end point in a chemical mechanical polishing (CMP) process conducted on a semiconductor wafer by utilizing a dual wavelength interference pattern generated by a laser source and detected by a laser detector as an indication of the thickness of material removed which provides a process window of about 4000 Å.

BACKGROUND OF THE INVENTION

In the fabrication of semiconductor devices, such as silicon wafers, a variety of different semiconductor equipment and/or processing tools are utilized. One of those processing tools is used for polishing thin, flat semiconductor wafers to obtain a planarized surface. A planarized surface is highly desirable on a shadow trench isolation (STI) layer, on an inter-layer dielectric (ILD) or on an inter-metal dielectric (IMD) layer which are frequently used in modem memory devices. The planarization process is important since in order to fabricate the next level circuit, a high resolution lithographic process must be utilized. The accuracy of a high resolution lithographic process can only be obtained when the process is carried out on a substantially flat surface. The planarization process is therefore an important processing step in the fabrication of a semiconductor device.

A global planarization process can be carried out by a technique known as chemical mechanical polishing or CMD. The process has been widely used on ILD or IMD layers in fabricating modem semiconductor devices. A CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer while the wafer is kept off-center on the pad in order to prevent polishing a non-planar surface onto the wafer. The wafer itself is also rotated during the polishing process to prevent polishing a tapered profile onto the wafer surface. The axis of rotation of the wafer and the axis of rotation of the pad are deliberately not collinear, however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 Å and about 10,000 Å. The uniformity requirement for ILD or IMD polishing is very stringent since non-uniform dielectric films lead to poor lithography and resulting window etching or plug formation difficulties. The CMP process has also been applied to polishing metals, for instance, in tungsten plug formation and in embedded structures. A metal polishing process involves a polishing chemistry that is significantly different than that required for oxide polishing.

The important component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydroxylation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in end point detection. The CPM process is frequently carried out without a clear signal about when the process is completed by using only empirical polishing rates and timed polish. Since the calculation of polish time required based on empirical polishing rates is frequently inaccurate, the empirical method fails frequently resulting in serious yield drops. Attempts have been made to utilize an end point mechanism including those of capacitive measurements and optical measurements. However, none of these techniques have been proven to be satisfactory in achieving accurate control of the dielectric layer removed.

Another method for achieving end point detection is marketed by the Applied Materials Corporation of Santa Clara, Calif. in a MIRRA® CMP device. In the MIRRA® device, a system of in-situ remote monitor (ISRM) is provided to determine end point by the concept of a periodic change of optical interference. In the MIRRA® device, signals received from a patterned wafer surface are processed by digital filtering algorithms by a PC programmable filter such that an optical interference intensity changes periodically with the thicknesses of removed surface material. For instance, a built-in laser source which is fixed at 6700 Å wavelength is utilized to cause interference at a wafer surface and thus producing a waveform received by a laser detector. The waveform generated by such a technique is shown in FIG. 1.

FIG. 1 illustrates four cycles of a waveform with each cycle corresponds to a removed material layer thickness of approximately 2437 Å. The technique is adequate to detect an end point in a polishing process wherein only a relatively thin layer, for instance, of only 2000 Å is removed. When a large thickness of material such as an IMD oxide layer having a thickness of at least 4000 Å is to be removed, the method frequently produces faulty results since the laser detector cannot distinguish which one of the waveform cycles the end point falls on. The wafer surface can therefore be either over-polished or under-polished by 2400 Å thickness. In other words, it is difficult for an operator to properly set a "window" of the polishing process to accurately control the thickness of the layer to be removed.

It is therefore an object of the present invention to provide a method for determining an end point in a CMP polishing process utilizing an optical interference technique that does not have the drawbacks or shortcomings of the conventional optical interference method.

It is another object of the present invention to provide a method for determining an end point in a CMP polishing process by utilizing a dual wavelength interference technique such that an expanded process window for end point detection is provided.

It is a further object of the present invention to provide a method for determining an end point in a CMP polishing process by utilizing a dual wavelength interference technique wherein two laser diode sources which emit different wavelength emissions are utilized.

It is another further object of the present invention to provide a method for determining an end point in a CMP polishing process by utilizing a dual wavelength interference technique in which laser emissions of two different wavelengths are utilized to produce a composite wavelength interference pattern by an additive effect.

It is still another object of the present invention to provide a method for determining an end point in a CMP polishing process by utilizing a dual wavelength interference technique in which laser emissions of two different wavelengths are utilized such that a waveform producing a process window of at least 4000 Å is generated.

It is yet another object of the present invention to provide a method for terminating an end point in a chemical mechanical polishing process conducted on a semiconductor wafer by utilizing a dual wavelength interference technique and detecting a preset end point in a waveform cycle which has a period of at least 4000 Å.

It is still another further object of the present invention to provide a method for terminating a chemical mechanical polishing process conducted on a semiconductor wafer at a preset end point that is suitable for removing material thicknesses of more than 4000 Å thick.

It is yet another further object of the present invention to provide an apparatus for determining an end point in a chemical mechanical polishing which includes a polishing platen equipped with a laser generator capable of generating emissions at two different wavelengths directed toward a sample surface such that a dual wavelength interference pattern is produced for detecting the end point.

SUMMARY OF THE INVENTION

In accordance with the present invention, a method and an apparatus for determining an end point in a chemical mechanical polishing process by a dual wavelength interference technique are provided.

In a preferred embodiment, a method for determining an end point in a polishing process can be carried out by the operating steps of first providing a sample to be polished, the sample has at least a surface layer and a base layer formed of different materials, the surface layer is adapted for penetration by a laser beam, an interface is formed between the surface layer and the base layer for reflecting the laser beam, providing a polishing platen which has installed thereon a polishing pad for removing at least partially the surface layer on the sample, the polishing platen further includes a laser generator and a laser detector situated in the platen for sending and receiving emissions toward and from the interface in the sample through a window provided in the polishing pad, rotating the sample and the polishing platen independently and frictionally engaging a top surface of the surface layer on the sample with a top surface of the polishing pad, emitting from the laser generator emissions which include two different wavelengths toward the interface in the sample, receiving a composite wavelength interference curve in the laser detector, and determining an end point in the composite wavelengths interference curve corresponding to a thickness of the surface layer retained.

The sample utilized in the method may be a semiconductor wafer. The surface layer on the sample may be a silicon oxide layer and the base layer on the sample may be formed of a material selected from the group consisting of silicon, polysilicon and metal. The two different wavelengths emitted from the laser generator has an additive effect in the composite wavelengths interference curve when reflected by a top surface of the surface layer and the interface in the sample. The laser generator may include two semiconductor diodes each generating an emission at a different wavelength in the range between about 1000 Å and about 10,000 Å. The laser generator may further include two semiconductor diodes each generating an emission at a different wavelength in the range between about 3500 Å and about 7500 Å. The composite wavelength interference curve generated has a period between cycles of waveform of not smaller than 3000 Å, and preferably not smaller than 4000 Å. The two different wavelengths emitted from the laser generator may be 4500 Å and 6700 Å, respectively. The polishing platen may have a surface area that is substantially larger than the surface area of the wafer.

In another preferred embodiment, a method for terminating a chemical mechanical process conducted on a semiconductor wafer at a preset end point is provided which may be carried out by the operating steps of first providing a semiconductor wafer which has an oxide layer on top, the oxide layer and a material layer which is not oxide underneath form an interface thereinbetween, then providing a polishing platen equipped with a polishing surface for removing at least partially the oxide layer; a laser generator and a laser detector for sending and receiving emissions to and from the interface in the wafer, then rotating the wafer and the polishing platen independently so that a top surface of the oxide layer frictionally engages the polishing surface on the platen, then emitting from the laser generator emissions including two different wavelengths toward the interface in the wafer and receiving a composite wavelength interference curve in the laser detector, and terminating the rotation between the wafer and the polishing platen when a preset end point in the composite wavelength interference curve is reached.

The material layer which is not an oxide situated underneath may be formed of a material selected from the group consisting of silicon, polysilicon and metal. The oxide layer on the semiconductor wafer may be an inter-layer dielectric material, a shallow trench isolation material or an inter-metal dielectric layer. The composite wavelength interference curve may be formed by interferences between laser emissions reflected from a top surface of the oxide layer and laser emissions reflected from the interface at two different wavelengths. The two different wavelengths may be selected from a range between about 3500 Å and about 7500 Å. The laser emissions that have two different wavelengths produce an additive effect in the composite wavelength interference curve when reflected by the top surface of the oxide layer and by the interface. The composite wavelength interference curve may have a period between cycles of waveform of not smaller than 3000 Å, and preferably not smaller than 4000 Å. The two different wavelengths emitted from the laser generator may be 4500 Å and 6700 Å, respectively. The wafer and the polishing platen may be rotated independently in the same clockwise or counterclockwise direction.

The present invention is further directed to an apparatus for determining an end point in a chemical mechanical polishing process which includes a polishing platen that has a polishing pad intimately joined thereon, the polishing platen further includes a laser generator and a laser detector installed therein for sending and receiving laser emissions through a window provided in the polishing pad, the laser generator generates emissions at two different wavelengths toward a sample positioned on the polishing platen producing a composite wavelength interference curve for receiving by the laser detector, means for rotating the polishing platen, and means for rotating a sample holder for holding a sample thereon and pressing a surface of the sample for frictionally engaging the polishing surface on the platen.

The sample utilized in the apparatus may be a semiconductor wafer which has an oxide layer coated thereon. The laser generator may include two semiconductor diodes such that laser emissions at two different wavelengths generated. The laser generator generates laser emissions at two different wavelengths in a range of between about 3500 Å and about 7500 Å. The laser generator may generate laser emissions at two different wavelengths of 4500 Å and 6700 Å, respectively. The sample may include an oxide layer formed over silicon, polysilicon or metal. The composite wavelength interference curve may have a period between cycles of waveform not smaller than 3000 Å, and preferably not smaller than 4000 Å.

BRIEF DESCRIPTION OF THE DRAWINGS

The objects, features and advantages of the present invention will become apparent from the following detailed description and the appended drawings in which.

DETAILED DESCRIPTION OF THE PREFERRED EMBODIMENT

Figure 1:
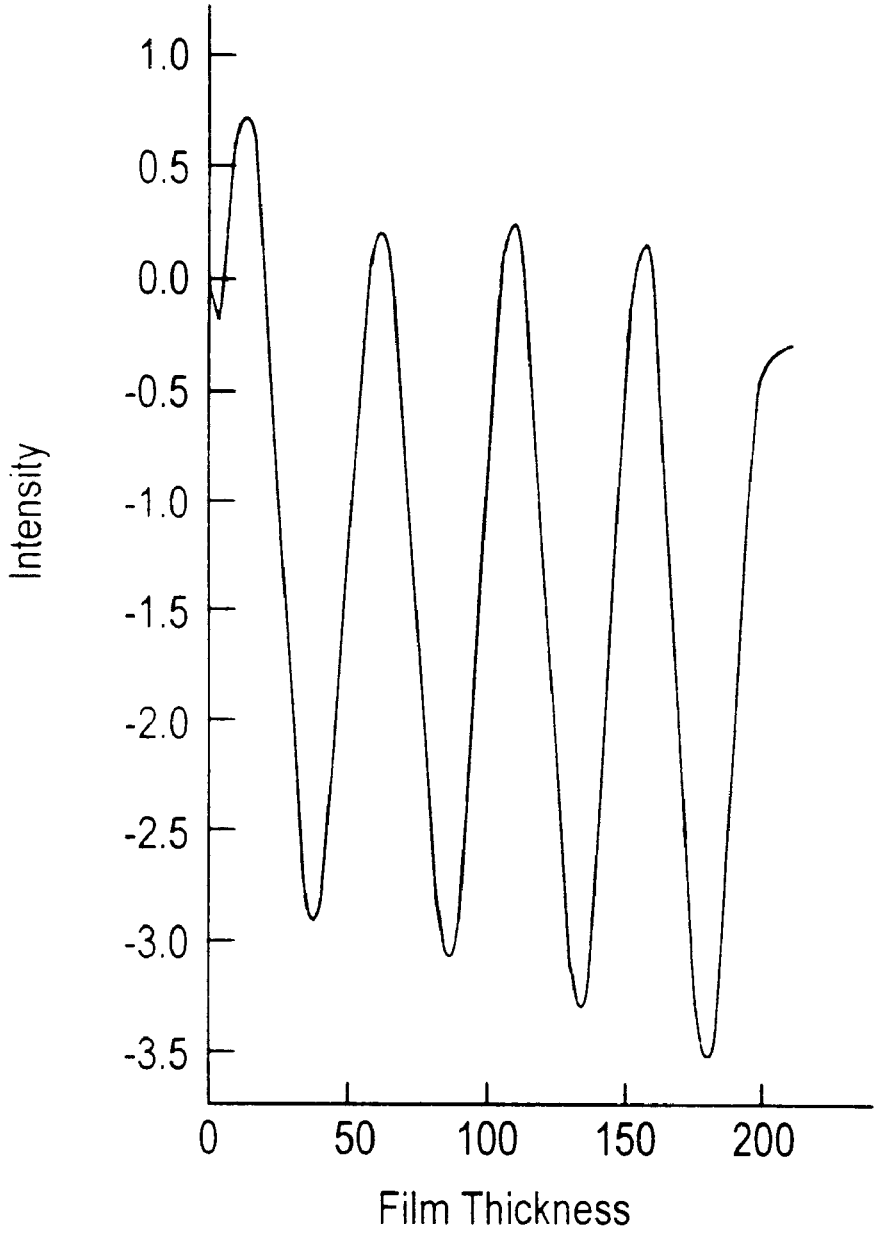
(Prior Art) FIG. 1
FIG. 1 is a graph illustrating an optical interference curve generated by a laser of 6700 Å wavelength and reflected from the surface of an oxide layer indicating a period between cycles of approximately 2437 Å.

The present invention discloses a novel method and apparatus for determining end point in a chemical mechanical polishing process by utilizing a dual wavelength interference technique. The present invention further discloses a method and apparatus for terminating a chemical mechanical polishing process conducted on a semiconductor wafer at a preset end point by utilizing a dual wavelength interference technique wherein the period, or a process window for detection is greatly expanded from that conventionally available of a single wavelength interference technique. For instance, instead of a process window of only 2400 Å (or a period between cycles in the waveform), the present invention novel technique provides a window for detection of at least 4000 Å such that a greatly expanded detection range is provided. The present invention method and apparatus may be utilized for detecting thickness of material removed from the surface of a semiconductor wafer of any thickness, but is particularly suitable for determining the thickness of material removed from a thick layer on a wafer surface.

In the present invention dual wavelength interference method, a laser generating source which may include two semiconductor diodes each generating a laser emission at a different wavelength is utilized. For instance, a suitable set of laser emission wavelengths utilized is 4500 Å and 6700 Å, respectively. While any suitable sets of wavelength of laser emission may be utilized, it is desirable that an two different wavelength emissions produce an additive effect in the waveform obtained after an interference process between emissions reflected from the wafer surface. For instance, instead of a period or a process window of 2400 Å available from a single wavelength interference pattern obtainable conventional, the present invention dual wavelength interference technique may produce a period of at least 4000 Å, i.e., a window that is almost twice as wide as that available from the conventional single wavelengths interference technique. This provides the great benefit of easy identification of an end point when a large thickness of dielectric material is removed. The problem occurring in the conventional method utilizing a single wavelength interference technique of mistakenly identifying by a whole period in the waveform is eliminated.

The present invention provides an end point detection method for oxide CMP process which may be utilized in a planarization process for ILD, IMD or STI layers by the concept of periodic interference change. By using a novel method of a dual wavelength interference, the range or the process window for end point detection can be greatly expanded, i.e., by almost 100%. The present invention end point detection method therefore increases wafer throughout efficiency and achieves wafer cost reduction.

Based on the concept of periodic change of optical interferences, the present invention method for end point detection utilizes a dual frequency laser emission source positioned in a rotating platform for a CMP process. Signals obtained from patterned wafer surface are processed through digital filtering algorithms in a PC programmable filter such that the interference intensity periodically changes with the thicknesses of the removed surface layer. For a built-in laser source having two semiconductor diodes at 4500 Å and 6700 Å wavelengths respectively, each cycle obtained in a composite waveform corresponds to a removed thickness of approximately 4000 Å. The present invention novel method therefore can be used to cover a wide range of dielectric layers including those of ILD, STI and IMD process windows.

For instance, in an ILD polishing process, an end point receipt may be first devised to fit different patterns and to cover variations of pre-thickness (to be removed) in a range of about 13,000 Å±1000 Å thickness. There are three important processing parameters must be predetermined for executing such CMP process. First, an initial dead time, such as 45 seconds, is first determined so that a cycle may start after a pre-thickness of 6000 Å is removed. In the second step, a window is set to cover a suitable range of the waveform to either catch a peak on the waveform, or a point having a fixed slope on the waveform, etc., as the end point. The third step is to determine an acceptable over-polish rate at, for instance, about 20% in order to meet a target post-polishing thickness. The three parameters achieved in the three processing steps therefore determine the range of the cycle of interference in order to cover a range from a pre-polishing-thickness to a target post-polishing-thickness at within 2000 Å. For instance, one cycle in the present invention composite interference waveform corresponds to a thickness of a removed layer of more than 4000 Å. The present invention novel method can therefore cover a process window that is at least two times of a process window available from the conventional single wavelength interference method. The present invention novel method can easily cover the process window for an IMD layer removal which is normally larger than that required for an ILD or STI layer.

Figure 2:
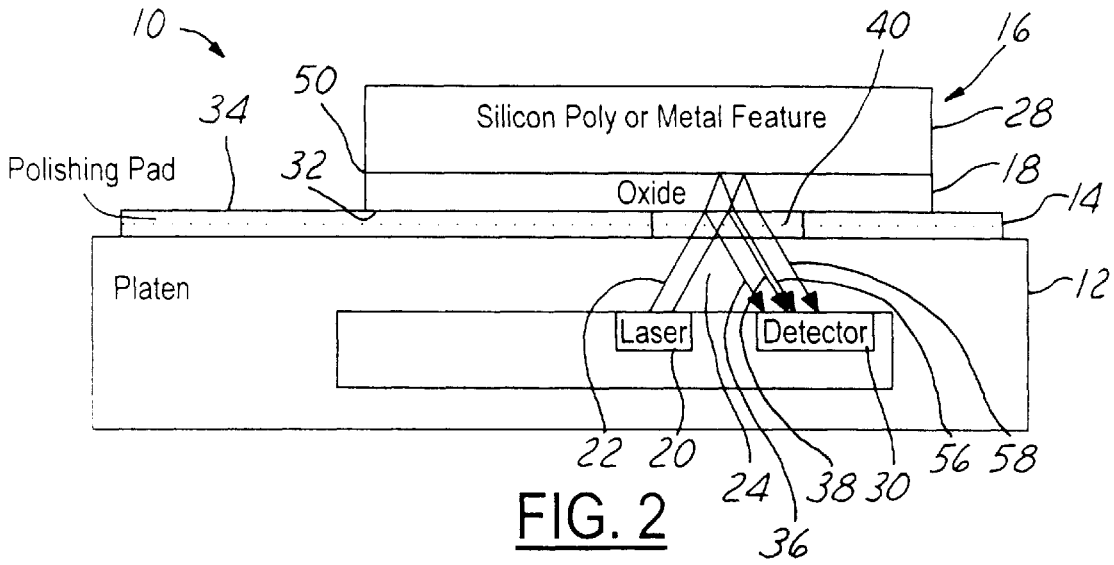
FIG. 2 is a cross-sectional view of the present invention apparatus wherein a platen is equipped with a laser source capable of generating laser emissions at two different wavelengths.

Referring now to FIG. 2, wherein a present invention apparatus 10 is shown. In the apparatus 10, a polishing platen 12 which is intimately joined to a polishing pad 14 is used as the rotating platen in the CMD apparatus. The rotating platen 12 is equipped with a laser generating source 20 which includes two semiconductor diodes (not shown) each capable of generating laser emissions at a different wavelength. For instance, as shown in FIG. 2, laser emissions 22 and 24 are each generated by a semiconductor diode at 4500 Å and 6700 Å, respectively.

Figure 3:
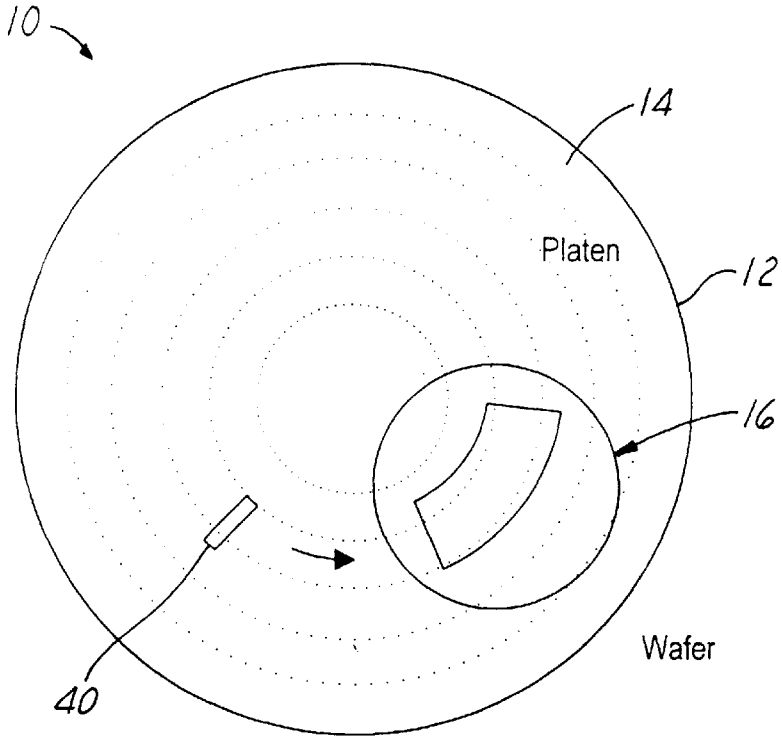
FIG. 3 is a plane view of the present invention apparatus with a wafer sample positioned on a polishing platen and a window in the platen for laser emission.

Also shown in FIG. 2 is a semiconductor device 16 which consists of an oxide coating layer 18 overlying a base material layer 28. The base material layer 28 may be formed of any suitable materials, including but not limited to silicon, polysilicon and metal. The semiconductor wafer 16 is pressed onto the rotating platen 12 such that a top surface 32 of the oxide layer 18 intimately contacting and frictionally engaging a top surface 34 of the polishing pad 14. Laser emissions 22, 24 from the laser source 20 irradiating onto surface 32 of the oxide layer 18 through a window 40 provided in the polishing pad 14. This is also shown in a plane view of FIG. 3.

The laser emissions 22, 24 from the laser source 20 are partially reflected by the oxide surface 32 into reflected beams 36 and 38. Part of the laser beams 22, 24 penetrates into the oxide layer 18 and are reflected by the interface 50 formed between the oxide layer 18 and the base material layer 28. The reflected beams are then deflected at the oxide surface 32 into laser beams 56 and 58 to be received by the laser detector 30. An interference occurs between the deflected beams 36, 38 and the deflected beams 56, 58 when the beams are received by the detector 30 to thus producing a dual wavelength interference waveform 60 (shown in FIG. 4).

It should be noted that waveform 60 is a composite waveform formed additively by the individual waveforms 70 and 80 resulting from the individual laser emissions 22 and 24. As shown in the present illustration, the laser emissions 22 and 24 each has a wavelength of 4500 Å and 6700 Å, respectively. It is noted that any suitable wavelength of laser emissions in the range between 1000 Å and 10,000 Å may be suitable used in the present invention method. It is preferred that a wavelength chosen between 3500 Å and 7500 Å be used. One requirement for the wavelength chosen is that the two waveforms produced should have an additive effect in order to produce an expanded period between cycles in the resulting composite waveform.

Figure 4:
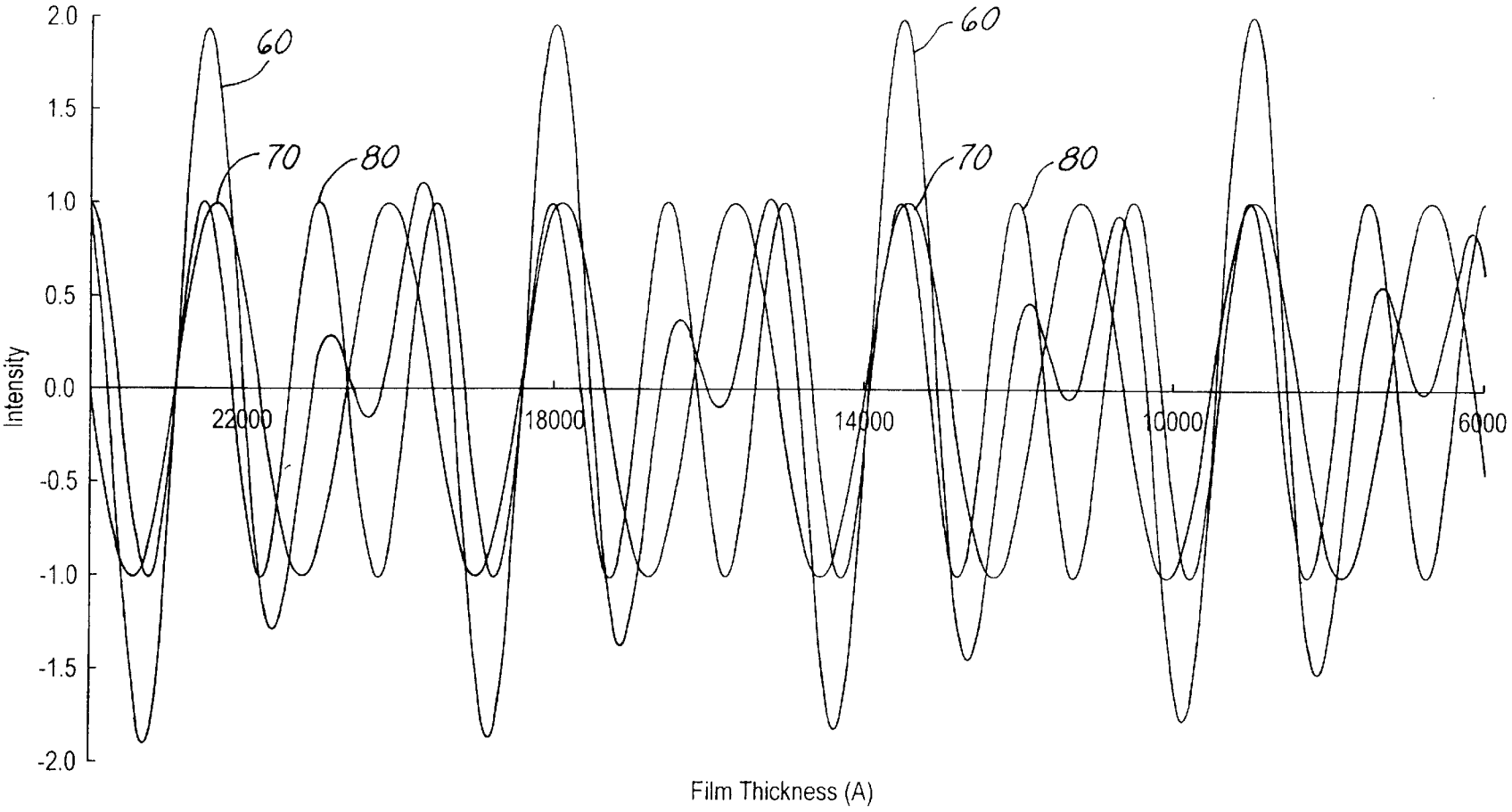
FIG. 4 is a graph illustrating a composite wavelength interference curve generated by the present invention method which has a period between cycles of the waveform of approximately 4000 Å.

As shown in FIG. 4, the advantages made possible by the present invention novel method and apparatus as self-evident. The period between cycles for the single waveform 70 is approximately 2400 Å, while the period between cycles for the single waveform 80 is approximately 1500 Å. The waveform 80 is produced at a laser wavelength of 6700 Å as previously described in the conventional single wavelength interference technique. The period between cycles available from the present invention composite waveform 60, as shown in FIG. 4, is approximately 4000 Å. The present invention method therefore produces a period between cycles that is significantly expanded from that available in the conventional single wavelength interference technique. The expanded range is almost twice of that previously available with the single wavelength at 6700 Å. This enables the present invention novel method to be used to cover a significantly wider process window such as that desirable in polishing an IMD layer.

IMPLEMENTATION EXAMPLE

Figure 5A:
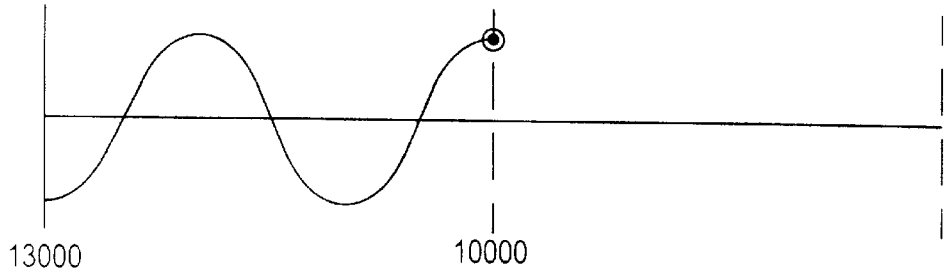
FIGS. 5A~5C are graphs illustrating an implementation example of the present invention method which utilizes a period between cycles of the wave form of approximately 2000 Å.
Figure 5B:
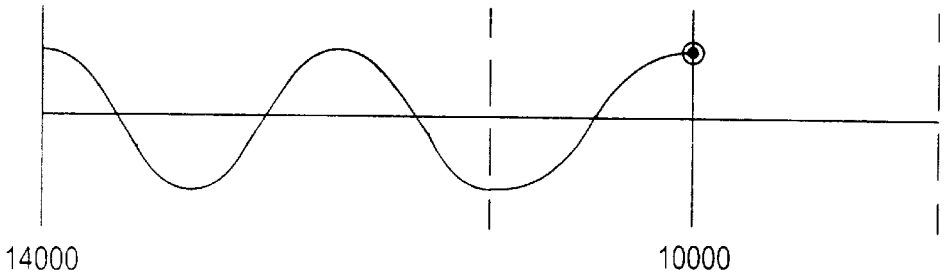
Figure 5C:
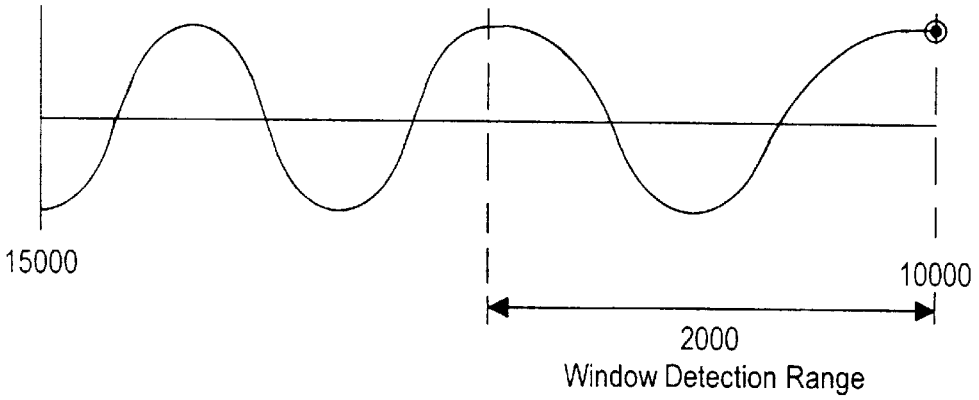

FIGS. 5A, 5B and 5C illustrate an implementation example of the present invention method which utilizes a period between cycles of the wave form of approximately 2000 Å, i.e., the window detection range.

One of the major objectives of the present invention novel method for an end point detection in a CMP process is to compensate for the pre-polish thickness variations in the wafer. The pre-polish thickness variations are normally caused by problems in the oxide deposition step. Utilizing the present invention and point detection method in the CMP process, regardless the magnitude of the pre-polish thickness variation, the end point can be accurately determined. For instance, as shown in FIGS. 5A~5C, when the wafer thickness prior to the CMP process is approximately 14,000±1,000, and a post-polish thickness of 10,000 Å is desired, the present invention novel method can be carried out by the following operating steps.

First, assuming the thickness change within a period is approximately 2,000 Å, i.e., the window detection range, which is determined by the wavelength of the laser source. The pre-polish thickness variation, or the wafer thickness variation prior to the CMP process, causes the entire interference trace to shift horizontally. When it is assumed that the end point window detection range is 2,000 Å, i.e., the total thickness change within a period of the laser wave, if the range is larger than 2000 Å, then the incorrect period will be detected. For example, in the case of a total thickness of 15,000 Å, the previous period will be detected such that polishing stops at 12,000 Å. It is therefore concluded that, in this particular case, a maximum pre-polish thickness variation that can be covered by the present invention method is 2,000 Å, i.e., a variation of 1,000 Å.

The present invention method is not limited to the thickness to be removed in an ILD, STI or IMD layer, since the end point window detection region can be pre-selected, i.e., the initial detection point can be set at any position. The only limitation of the method is the wavelength of the laser detection source, i.e., the thickness variations which determines the window detection range. In a conventional fabrication method for ILD or STI which utilizes thin oxide layers, the thickness control for the oxide deposition process is well within the 2,000 Å variation. In thicker IMD layers, the pre-polishing thickness variation before the CMP process frequently exceeds 2,000 Å which leads to end point detection failure when an incorrect period is detected.

The present invention novel method can further utilize a dual wavelength laser emissions such that the total thickness detection by the interference wave period can be extended to 4,000 Å. This is sufficient to cover the pre-polishing thickness variations in most IMD fabrication processes. The present invention novel method can therefore be advantageously used in detecting thickness in ILD, STI or IMD processes.

The present invention novel method can further be extended to the use of multi-wavelength laser emissions, i.e., therefore not limited by the dual-wavelength, as long as the magnified interference of the laser wave is sufficient to cover the thickness range in a single period.

The present invention novel method and apparatus have therefore been amply demonstrated in the above descriptions and the appended drawings of FIGS. 2~5C. It should be noted that while the present invention novel method and apparatus were illustrated in the removal process of an oxide layer, the method and apparatus can be equally utilized in the removal of any material layers on a semiconductor substrate as long as the layer permits a partial reflection and penetration by laser emissions. The industrial applicability of the present invention method and apparatus is therefore in no way limited by the above illustration.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. A method for determining an end point in a polishing process comprising the steps of:

providing a sample to be polished, said sample having at least a surface layer and a base layer formed of different materials, said surface layer material is adapted for penetration by a laser beam, an interface formed between said surface layer and said base layer for reflecting said laser beam, providing a polishing platen having installed thereon a polishing pad for removing at least partially said surface layer on said sample, said polishing platen further comprises a laser generator and a laser detector situated therein for sending and receiving emissions toward and from said interface in said sample through a window provided in said polishing pad, rotating said sample and said polishing platen independently and frictionally engaging a top surface of said surface layer on said sample with a top surface of said polishing pad, emitting from said laser generator emissions comprising two different wavelengths toward said interface in said sample and receiving a composite wavelength interference curve in said laser detector, and determining an end point in said composite wavelength interference curve corresponding to a thickness of said surface layer retained.

2. A method for determining an end point in a polishing process according to claim 1, wherein said sample is a semiconductor wafer.

3. A method for determining an end point in a polishing process according to claim 1, wherein said surface layer on said sample is a silicon oxide layer and said base layer on said sample is formed of a material selected from the group consisting of silicon, polysilicon and metal.

4. A method for determining an end point in a polishing process according to claim 1, wherein said two different wavelengths emitted by said laser generator having an additive effect in said composite wavelength interference curve when reflected by a top surface of said surface layer and said interface in said sample.

5. A method for determining an end point in a polishing process according to claim 1, wherein said laser generator comprises two semiconductor diodes each generating an emission at a different wavelength in the range between about 1000 Å and about 10,000 Å.

6. A method for determining an end point in a polishing process according to claim 1, wherein said laser generator comprises two semiconductor diodes each generating an emission at a different wavelength in the range between about 3500 Å and about 7500 Å.

7. A method for determining an end point in a polishing process according to claim 1, wherein said composite wavelength interference curve has a period between cycles of waveform of not smaller than 3000 Å.

8. A method for determining an end point in a polishing process according to claim 1, wherein said composite wavelength interference curve has a period between cycles of waveform of preferably not smaller than 4000 Å.

9. A method for determining an end point in a polishing process according to claim 1, wherein said two different wavelengths emitted from said laser generator are 4500 Å and 6700 Å.

10. A method for determining an end point in a polishing process according to claim 1, wherein said polishing platen having a surface area substantially larger than a surface area of said sample.

11. A method for terminating a chemical mechanical polishing (CMP) process conducted on a semiconductor wafer at a preset end point comprising the steps of:

providing a semiconductor wafer having an oxide layer on top, said oxide layer and a material layer that is not an oxide situated underneath form an interface thereinbetween, providing a polishing platen equipped with a polishing surface for removing at least partially said oxide layer; a laser generator and a laser detector for sending and receiving emissions to and from said interface in said wafer, rotating said wafer and said polishing platen independently so that a top surface of said oxide layer frictionally engages said polishing surface on the platen, emitting from said laser generator emissions comprising two different wavelengths toward said interface in said wafer and receiving a composite wavelength interference curve in said laser detector, and terminating said rotation between said wafer and said polishing platen when a preset end point in said composite wavelength interference curve is reached.

12. A method for terminating a chemical mechanical polishing process conducted on a semiconductor wafer at a preset end point according to claim 11, wherein said material layer that is not an oxide situated underneath is selected from the group consisting of silicon, polysilicon and metal.

13. A method for terminating a chemical mechanical polishing process conducted on a semiconductor wafer at a preset end point according to claim 11, wherein said oxide layer on said semiconductor wafer is an inter-layer dielectric (ILD) layer, a shallow trench isolation (STI) layer or an inter-metal dielectric (IMD) layer.

14. A method for terminating a chemical mechanical polishing process conducted on a semiconductor wafer at a preset end point according to claim 11, wherein said composite wavelength interference curve is formed by interferences between laser emissions reflected from a top surface of said oxide layer and laser emissions reflected from said interface at two different wavelengths.

15. A method for terminating a chemical mechanical polishing (CMP) process conducted on a semiconductor wafer at a preset end point according to claim 14, wherein said two different wavelengths are selected in a range between about 3500 Å and about 7500 Å.

16. A method for terminating a chemical mechanical polishing (CMP) process conducted on a semiconductor wafer at a preset end point according to claim 11, wherein said laser emissions having two different wavelengths produce an additive effect in said composite wavelength interference curve when reflected by a top surface of the oxide layer and said interface.

17. A method for terminating a chemical mechanical polishing (CMP) process conducted on a semiconductor wafer at a preset end point according to claim 11, wherein said composite wavelength interference curve has a period between cycles of waveform of not smaller than 3000 Å.

18. A method for terminating a chemical mechanical polishing (CMP) process conducted on a semiconductor wafer at a preset end point according to claim 11, wherein said composite wavelength interference curve has a period between cycles of waveform of preferably not smaller than 4000 Å.

19. A method for terminating a chemical mechanical polishing (CMP) process conducted on a semiconductor wafer at a preset end point according to claim 11, wherein said two different wavelengths emitted from said laser generator are 4500 Å and 6700 Å.

20. A method for terminating a chemical mechanical polishing (CMP) process conducted on a semiconductor wafer at a preset end point according to claim 11, wherein said wafer and said polishing platen are rotated independently in the same clockwise or counterclockwise direction.

21. An apparatus for determining an end point in a chemical mechanical polishing (CMP) process comprising:

a polishing platen having a polishing pad intimately joined thereon, said polishing platen further comprises a laser generator and a laser detector installed therein for sending and receiving laser emissions through a window provided in said polishing pad, said laser generator generates emissions at two different wavelengths toward a sample positioned on said polishing platen producing a composite wavelength interference curve for receiving by said laser detector for determining a polishing end point, means for rotating said polishing platen, means for rotating a sample holder for holding a sample thereon and pressing a surface of said sample for frictionally engaging the polishing surface on said platen until said end point is reached.

22. An apparatus for determining an end point in a chemical mechanical polishing process according to claim 21, wherein said sample is a semiconductor wafer.

23. An apparatus for determining an end point in a chemical mechanical polishing process according to claim 21, wherein said laser generator comprises two semiconductor diodes such that laser emissions at two different wavelengths are generated.

24. An apparatus for determining an end point in a chemical mechanical polishing process according to claim 21, wherein said laser generator generates laser emissions at two different wavelengths in a range between about 3500 Å and about 7500 Å.

25. An apparatus for determining an end point in a chemical mechanical polishing process according to claim 21, wherein said laser generator generates laser emissions at two different wavelengths of 4500 Å and 6700 Å.

26. An apparatus for determining an end point in a chemical mechanical polishing process according to claim 21, wherein the sample comprises an oxide layer formed over silicon, polysilicon or metal.

27. An apparatus for determining an end point in a chemical mechanical polishing process according to claim 21, wherein said composite wavelength interference curve has a period between cycles of waveform of not smaller than 3000 Å.

28. An apparatus for determining an end point in a chemical mechanical polishing process according to claim 21, wherein said composite wavelength interference curve has a period between cycles of waveform of preferably not smaller than 4000 Å.

* * * * *